US006550494B2

(12) United States Patent
Yoneda et al.

(10) Patent No.: US 6,550,494 B2
(45) Date of Patent: Apr. 22, 2003

(54) POSITION MEASURING DEVICE OF ELECTROMAGNETICALLY OPERATED ENGINE VALVE DRIVE SYSTEM AND METHOD FOR ATTACHING THE SAME

(75) Inventors: Hiroshi Yoneda, Ibaraki (JP); Masahiro Kurita, Ibaraki (JP); Yasuo Kouda, Kawasaki (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/813,370

(22) Filed: Mar. 21, 2001

(65) Prior Publication Data

US 2001/0035213 A1 Nov. 1, 2001

(30) Foreign Application Priority Data

Mar. 21, 2000 (JP) ..... 2000-078224

(51) Int. Cl.[7] ..... F16K 37/00
(52) U.S. Cl. ..... 137/554; 251/129.1; 123/90.11
(58) Field of Search ..... 137/554; 251/129.1; 123/90.11

(56) References Cited

U.S. PATENT DOCUMENTS 3,678,425 A * 7/1972 Holmes, Jr. ..... 335/207
4,533,890 A 8/1985 Patel ..... 335/234
4,546,388 A * 10/1985 Williams, Jr. ..... 348/730
4,967,227 A 10/1990 Suzuki et al. ..... 355/32
5,144,977 A * 9/1992 Eggerton et al. ..... 137/554
5,518,028 A * 5/1996 Walker ..... 137/554
5,769,043 A 6/1998 Nitkiewicz ..... 123/90.11
5,857,435 A 1/1999 Yang ..... 123/65 VB
5,983,847 A 11/1999 Miyoshi et al. ..... 123/90.11
6,213,147 B1 * 4/2001 Gramann et al. ..... 137/554
6,343,577 B2 * 2/2002 Toriumi ..... 123/90.11

FOREIGN PATENT DOCUMENTS

DE 298 14 211 U1 11/1998
JP 6-180242 6/1994

OTHER PUBLICATIONS

H. Kawamura, "Solenoid driving device for valve," Patent Abstracts of Japan, 03047412, Feb. 28, 1991, Abstract only.

* cited by examiner

*Primary Examiner*—John Rivell
(74) *Attorney, Agent, or Firm*—Foley & Lardner

(57) ABSTRACT

An engine valve (6) such as an intake valve or exhaust valve is driven to open or close a corresponding intake or exhaust port by attracting an armature (1) onto one of first and second electromagnets (2, 3) and a position of the armature, viz., the position of the engine valve is measured by a permanent magnet (7) and a Hall effect device (8). An adhesive layer (9) whose hardness is lower than the drive axle (5) is used to attach the permanent magnet (7) onto the drive axle (5).

34 Claims, 3 Drawing Sheets

POSITION MEASURING DEVICE OF ELECTROMAGNETICALLY OPERATED ENGINE VALVE DRIVE SYSTEM AND METHOD FOR ATTACHING THE SAME

BACKGROUND OF THE INVENTION a) Field of the Invention

The present invention relates to a position measuring device of an electromagnetic actuator for an electromagnetically operated engine valve drive system and a method for attaching the same.

b) Description of the Related Art

A cam shaft drive system has still been dominated in an open-and-closure drive of intake and exhaust valves of an electronically controlled internal combustion engine although the electronically controlled engine has been adopted in automotive vehicles.

As the electronically controlled engine has become generalized, an application of an electronic control system to the open-and-closure drive system for the intake and exhaust valves has strongly been demanded from standpoints of a further improvement in a fuel consumption and an exhaust gas purification.

To meet this demand, a U.S. Pat. No. 5,769,043 issued on Jun. 23, 1998 to James A. Nitkiewicz has proposed an apparatus for electromagnetically driving the intake and exhaust valves to open and close intake and exhaust ports of the engine using an electromagnet actuator, viz., an electromagnetically operated engine valve drive system.

In the above-described electromagnetically operated engine valve drive system, independent controls of both of a valve open timing and a valve closure timing and, furthermore, a valve displacement control are made possible.

These valve open-and-closure timing and valve displacement controls can optimally be made under various engine driving situations. To achieve this, it is necessary to detect accurately a position of a movable section of the electromagnetic actuator which reciprocates at a high velocity so that the valve displacement of the intake or exhaust valve can be recognized.

In this case, it is generally necessary to measure an instantaneous position of the movable section of the actuator with an extremely high accuracy and with no contact over a considerably long stroke. To meet this necessity, a position measuring device utilizing a Hall effect has been used in the above-described electromagnetically operated engine valve drive system. A kind of the position measuring device includes a magnetic field generating and detecting device (coupler) of a permanent magnet and a Hall effect device.

A Japanese Patent Application First Publication No. Heisei 6-180242 published on Jun. 28, 1994 exemplifies an area airflow meter to which the above-described position detecting device of the permanent magnet and Hall effect devices (or magnetic resistance elements) is applied.

In the above-identified Japanese Patent Application First Publication, one of the permanent magnet and the magnetic field detecting device, for example, the permanent magnet is attached onto its movable section, a strength of the magnetic field that the permanent magnet creates is measured by the attached magnetic field detecting device so that the position of the movable section can be measured.

SUMMARY OF THE INVENTION

In the above-described previously proposed electromagnetically operated engine valve drive system, no consideration is given to an attaching of the permanent magnet onto the movable section of the valve actuator so that a reduction in a reliability cannot be avoided and a maintenance of a measuring accuracy becomes difficult.

Since, in the previously proposed electromagnetically operated engine valve drive system, the movable section of the actuator has a considerably high velocity in the vicinities of start and end points of the stroke by which the movable section can be moved. Hence, if the movable section collide with a stationary section of the actuator at a high velocity region at proximities to the start and end points of the stroke, a large impulsive (collision) force due to an acceleration reaching up to several thousand's G (gravity) would be received.

Therefore, in order to avoid an occurrence of the collision, to suppress the collision velocity to be low even when such a collision as described above has occurred, to reduce a noise or shock, or to achieve a long extension of life, a velocity variation control during the stroke has been applied such that the position of the movable section is measured and the velocity of the movable section is slowed down at proximities of start and end points of the stroke.

However, even if the velocity variation control has been applied, the occurrence in the collision of the movable section with the stationary section cannot be avoided when an initial adjustment of the device is carried out or when an abnormality in a controller for controlling the electromagnetically operated engine valve drive system occurs although no collision may occur in a steady state.

Since no consideration for the attaching of the position detecting permanent magnet with respect to the movable section of the valve actuator is given, so that a reliability of the permanent magnet would be reduced.

At this time, it is a general practice that the movable section of the actuator is made of a ferromagnetic material such as a steel integrated with a movable element such as an armature for electromagnets.

In the above-described previously proposed position detecting devices, no consideration for the attaching of position detecting permanent magnet onto the movable section of the actuator is given so that a disturbance of the magnetic field due to the permanent magnet occurs and the measurement accuracy can be reduced.

It is, hence, an object of the present invention to provide improved position measuring device for the electromagnetically operated engine valve drive system and method for attaching the same which can sufficiently suppress a reduction of a reliability in the attaching of the position detecting device onto the movable section of the electromagnetically operated engine valve drive system and can sufficiently suppress a reduction of a position measuring accuracy due to the attaching of the permanent magnet onto the movable section of the actuator with a simple structure.

According to one aspect of the present invention, there is provided a method for attaching a position measuring device of an electromagnetic actuator for an electromagnetically operated engine valve drive system, the electromagnetic actuator comprising: a movable section associated with an engine valve; and a permanent magnet used to detect a displacement position of the movable section, the method comprising attaching the permanent magnet onto the movable section via such a predetermined material as to have a lower hardness than that of the movable section.

According to another aspect of the present invention, there is provided a position measuring device of an electromagnetic actuator for an electromagnetically operated engine valve drive system, the position measuring device comprising: a movable section associated with an engine valve; and a permanent magnet attached onto the movable section via such a predetermined material as to have a lower hardness than that of the movable section to detect a displacement position of the movable section.

This summary of the invention does not necessarily describe all necessary features so that the invention may also be a sub-combination of these described features.

DETAILED DESCRIPTION OF THE PREFERRED EMBODIMENTS

Reference will hereinafter be made to the drawings in order to facilitate a better understanding of the present invention.

Figure 1:
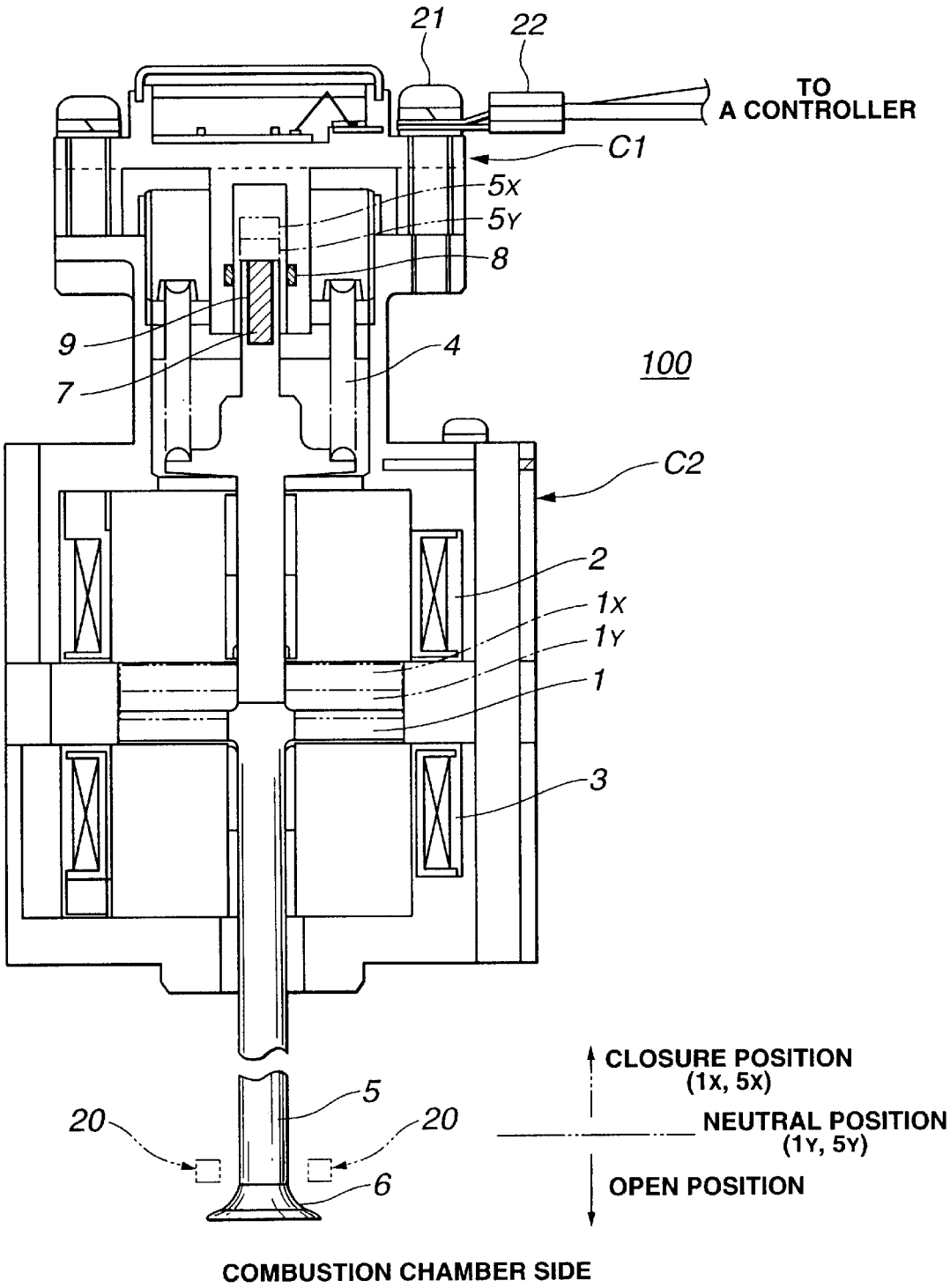
FIG. 1 is a schematic cross sectional view of an electromagnetic actuator for an electromagnetically operated engine valve drive system to which a first preferred embodiment of an attaching method for a permanent magnet onto a movable section of the electromagnetic actuator for the electromagnetically operated engine valve drive system according to the present invention is applicable.

FIG. 1 shows an example of an electromagnetic actuator for an electromagnetically operated engine valve drive system to which a method for attaching a permanent magnet onto a movable section of the electromagnetic actuator in a first preferred embodiment according to the present invention is applicable.

An electromagnetic actuator 100, as shown in FIG. 1, includes: a main body, viz., a stationary section; and a movable section. The main body (stationary section) includes: an upper casing C1; and a lower casing C2 within which a pair of first and second electromagnets 2 and 3 are housed. The movable section includes a drive axle 5 having an armature 1 (also called, a movable element) made of a material having a magnetic property. A spring 4 is interposed between the movable section and the upper casing C1 of the stationary section. An engine valve 6 (an intake valve or exhaust valve) is attached onto drive axle 5 associated with armature 1.

When engine valve 6 is to be moved in an upward direction of FIG. 1, viz., engine valve 6 is to be closed, first electromagnet 2 is energized to attract armature 1 thereonto so that armature 1, viz., engine valve 6 is held at a closure position denoted by a phantom line of $\mathbf{1}_x$ and, therefore, engine valve 6 has reached onto a valve seat 20.

When engine valve 6 is to be moved in a downward direction of FIG. 1, viz., engine valve 6 is to be opened, second electromagnet 3 is energized (first electromagnet 2 is de-energized) to attract armature 1 thereonto so that armature 1, viz., engine valve 6 is held at an open position denoted by a solid line of 1 and, therefore, engine valve 6 has separated in the downward direction (combustuion chamber side) from valve seat 20.

It is noted that spring 4 serves to bias armature 1 at a neutral position (denoted by a phantom line of $\mathbf{1}_y$) which corresponds to an intermediate position of engine valve 6 between closure position and open position during no power supply to first and second electromagnets 2 and 3.

It is also noted that valve seat 20 is attached onto an intake port or exhaust port of an internal combustion engine so that an end of a valve body of engine valve 6 is faced toward combustion chamber side and first and second electromagnets 2 and 3 are electrically connected to a controller via terminals 22 located at a screw head 21 of the main body as shown in FIG. 1.

It is further noted that both controls of a valve open timing and a valve closure timing are independently made possible and a valve displacement control is also made possible using the controller. To achieve these controls, it is necessary to control accurately a driven position of armature 1. At this time, it is necessary to measure accurately the position of the engine valve 6.

Therefore, as shown in FIG. 1, a bar shaped permanent magnet 7 and a Hall effect device 8 are mounted on the main body, viz., the stationary section and the movable section of electromagnetic actuator 100 to form a position measuring device (coupler).

Permanent magnet 7 is attached, as shown in FIG. 1, onto an upper end of drive axle 5 which is opposite to a lower end of drive axle 5 onto which engine valve body 6 is attached.

The solid-state Hall effect device 8 is attached onto main body, viz., the stationary section of the actuator 100 so as to face against permanent magnet 7.

Hence, since the position of permanent magnet 7 with respect to Hall effect device 8 is changed according to a displacement of drive axle 5 so that a strength of a magnetic field detected by Hall effect device 8 is varied, the position of permanent magnet 7 with respect to the position of Hall effect device 8 can be detected in accordance with the change in the strength of the magnetic field, i.e., the position of engine valve 6 such as the intake valve or exhaust valve can be detected.

At this time, the Hall effect device 8 is juxtaposed to a movement direction of armature 1. When armature 1 is placed at the neutral position, a center position of an elongated direction of permanent magnet 7 whose upper and lower ends are magnetic poles is adjusted to become coincident with that of Hall effect device 8.

Thereby, Hall effect device 8 can measure a magnetic field strength generated radially from permanent magnet 7 so that the position of armature 1 can be measured.

In FIG. 1, a reference numeral 9 denotes an adhesive layer by means of which permanent magnet 7 is attached onto the upper end of drive axle 5.

Figure 2:
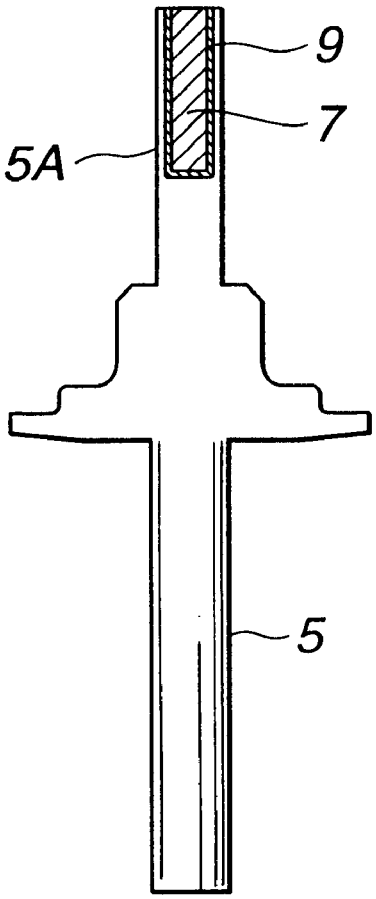
FIG. 2 is an expanded view of an essential part of the movable section of the electromagnetic actuator in the first preferred embodiment shown in FIG. 1.

FIG. 2 shows an expanded view of the attaching portion of permanent magnet 7 to drive axle 5 by means of adhesive layer 9.

As shown in FIG. 2, a cylindrical portion 5A is formed on the upper end of drive axle 5. Permanent magnet 7 can be inserted into the cylindrical portion 5A with a predetermined clearance.

After an epoxy resin series adhesive is injected by a predetermined quantity (epoxide resin series adhesive) into cylindrical portion 5A, permanent magnet 7 is inserted into cylindrical portion 5A to harden the adhesive so that the permanent magnet 7 can be attached onto the drive axle 5. At this time, the hardening is carried out so that adhesive layer 9 is formed with a substantially uniform thickness.

The reason that the epoxy resin series adhesive is used as adhesive layer 9 will be described below.

The epoxy resin series adhesive has a superior characteristic such that a predetermined intensity can be maintained while maintaining an elasticity to some degree due to its composition.

Consequently, permanent magnet 7 can elastically be held with a sufficient strength against drive axle 5. Even if a strong shock (impulsive force) is applied to armature 1, permanent magnet 7 can easily be protected and a sufficiently high reliability can be maintained.

A Samarium-Cobalt series permanent magnet material is often used in permanent magnet 7 for the position detection in the electromagnetically operated engine valve drive system from the standpoints of a thermal stability, an anti-corrosion characteristic, and a high coercive force characteristic. However, this permanent magnet material is considerably fragile. Hence, in the previously proposed electromagnetically operated engine valve drive system described in the BACKGROUND OF THE INVENTION, the reliability of the system cannot be maintained.

However, since, in the first embodiment shown in FIGS. 1 and 2, the impulsive force is absorbed due to the presence of adhesive layer 9 and the impulsive force applied to permanent magnet 7 is sufficiently relieved and, hence, the reliability can sufficiently be maintained.

As described above, as adhesive layer 9, such a material as to have a function required for the impulsive force applied from drive axle 5 to be relived on permanent magnet 7, viz., such a material as to have a lower hardness than the material of drive axle 5 is adopted regardless of a property of the material.

Hence, adhesive layer 9 is not only made of the epoxy resin series adhesive but also may be made of another synthetic resin series adhesive. Furthermore, permanent magnet 7 may be held by filing a metal such as Aluminium or Copper within cylindrical portion 5A.

Figure 3:
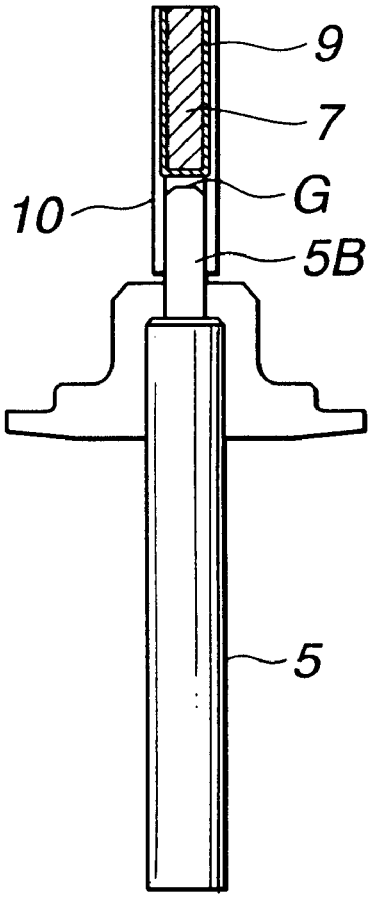
FIG. 3 is an expanded view of an essential part of the movable section to which a second preferred embodiment of the attaching method of the permanent magnet according to the present invention is applicable.

Next, a second preferred embodiment of the attaching method for the permanent magnet onto the movable section according to the present invention with reference to FIG. 3.

FIG. 3 shows an expanded view of the upper end of drive axle 5 shown in FIG. 1.

The other structure than drive axle 5 shown in FIG. 3 is the same as that described in the first embodiment with reference to FIGS. 1 and 2.

In FIG. 3, a reference numeral 10 denotes a hollow cylindrical member (sleeve) made of a non-magnetic property material.

In FIG. 3, a small diameter section 5B is formed on the upper end of the drive axle 5 whose diameter is finer than outer cylindrical member 10. By inserting a lower end of cylindrical member 10 into small diameter section 5B, cylindrical member 10 is attached onto the upper end of drive axle 5.

Then, after inserting the permanent magnet 7 into the inside of cylindrical member 10 through the upper end of adhesive layer 9 is adhered onto permanent magnet 7.

In the second embodiment, a lower end of permanent magnet 7 is formed with a spatial gap section (G) against the upper end of small diameter section 5B.

In the second embodiment shown in FIG. 3, the permanent magnet 7 is attached onto the drive axle 5 via adhesive layer 9 and is attached onto drive axle 5 via cylindrical member 10 having the low hardness than the drive axle 5. Consequently, even if the strong impulsive force is applied to the armature 1, adhesive layer 9 serves to absorb the impulsive force so that the impulsive force to be applied to permanent magnet 7 is sufficiently relieved. Hence, a sufficient reliability can be maintained.

In addition, since, in the second embodiment, permanent magnet 7 is held with cylindrical member 10 made of the non-magnetic property material such as Alminium, there is no possibility that the magnetic field due to the presence of permanent magnet 7 is disturbed by a magnetic property material present in a proximity to permanent magnet 7. At this time, since the gap section G which serves as a magnetic shield member is formed around the lower end of permanent magnet 7, there is no possibility that the magnetic field developed by permanent magnet 7 is disturbed by the presence of drive axle 5 which is the magnetic property material.

In the position detecting device to which the attaching method in each preferred embodiment is applicable, the magnetic field developed by permanent magnet 7 is detected so that the position of the permanent magnet can be detected.

Hence, if some magnetic material is present in the proximity to permanent magnet 7, an unnecessary magnetic path is formed so that there occurs an error in a symmetry of a magnetic field distribution to magnetic poles of permanent magnet 7.

This error in the symmetry appears in a form of a reduction in the strength of a magnetic field in the proximity to the magnetic poles of permanent magnet 7 near to the magnetic property material. Hence, a reduction in a sensitivity of measuring the position is resulted.

Figure 4:
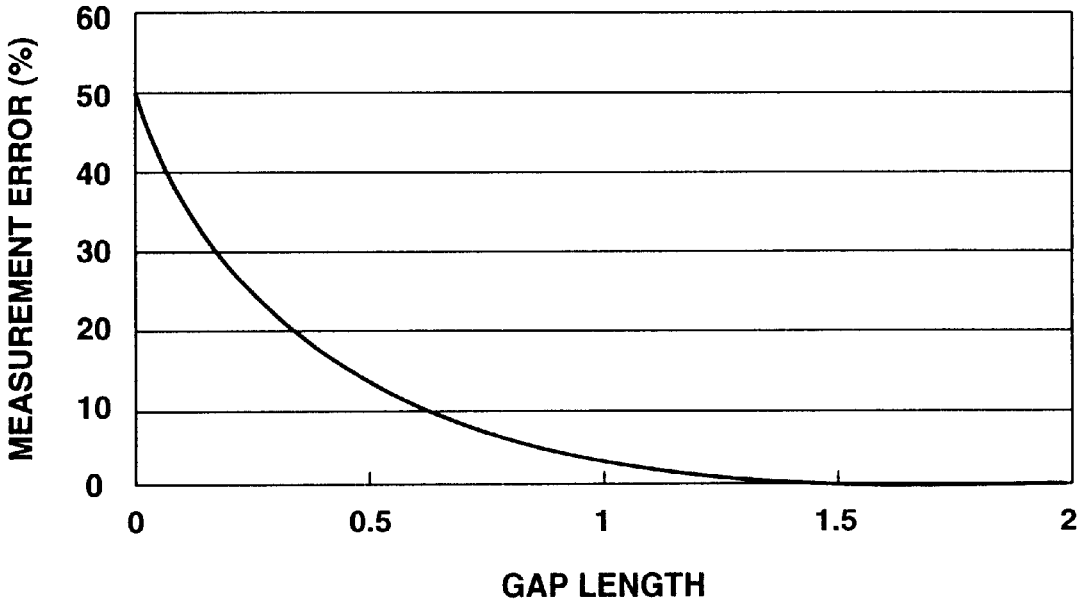
FIG. 4 is a characteristic graph representing a relationship between a gap length and a measurement error in the second preferred embodiment shown in FIG. 3.

FIG. 4 shows a result of measurement of a relationship between a length of gap section G and the measurement error.

It will be appreciated that no practical problem occurs if the length of gap section G is equal to or longer than 0.8 millimeters.

It is noted that the magnetic shield material such as a permalloy (Ni 77 to 85%, Fe 10 to 20%, and Cr 2 to 4% (or Mo 4%)) may be inserted or filled in gap section G so that the gap length thereof can be shortened.

Hence, in the second preferred embodiment shown in FIG. 3, a correct formation of the magnetic field required to obtain a highly accurate detection of the position by means of permanent magnet 7 can positively and easily be achieved. Consequently, a highly accurate position measurement under a sufficient measuring sensitivity can easily be achieved.

It is noted that the electromagnetically operated engine valve drive system includes the electromagnetic actuator 100 and controller and electromagnetic actuator 100 shown in FIG. 1 is disposed in each of cylinders of the electronically controlled internal combustion engine.

The entire contents of a Japanese Patent Application No. 2000-078224 (filed in Japan on Mar. 21, 2000) are herein incorporated by reference. Although the invention has been described above by reference to certain embodiment of the invention, the invention is not limited to the embodiments described above.

Modifications and variations of the embodiments described above will occur to those skilled in the art in the light of the above teachings.

The scope of the invention is defined with reference to the following claims.

What is claimed is:

1. A method for attaching a position measuring device of an electromagnetic actuator, the electromagnetic actuator comprising a movable section and a permanent magnet used to detect a displacement position of the movable section, the method comprising attaching the permanent magnet onto the movable section elastically via a predetermined material that has a lower hardness than that of the movable section, wherein a magnetic shield portion is disposed between the movable section and the permanent magnet.

2. A method for attaching a position measuring device of an electromagnetic actuator as claimed in claim 1, wherein the predetermined material is a substantially cylindrical shaped material.

3. A method for attaching a position measuring device of an electromagnetic actuator as claimed in claim 1, wherein the magnetic shield portion is a gap formed between the movable section and the permanent magnet.

4. A method for attaching a position measuring device of an electromagnetic actuator as claimed in claim 3, wherein the gap is filled with a permalloy.

5. A position measuring device for an electromagnetic actuator having a movable section associated with a valve comprising:

a permanent magnet attached onto the movable section elastically via a predetermined material that has a lower hardness than that of the movable section to detect a displacement position of the movable section; and a component arranged to detect a magnetic field of the permanent magnet for measuring the position of the movable section, wherein the predetermined material is an adhesive layer enclosing the permanent magnet, wherein the movable section comprises a small diameter section and a hollow cylindrical member whose inner periphery is fitted into an outer periphery of the small diameter section, wherein the adhesive layer is interposed between the inner periphery of the hollow cylindrical member and an outer periphery of the permanent magnet.

6. A position measuring device for an electromagnetic actuator as claimed in claim 5, wherein the adhesive layer is made of an epoxy resin series adhesive.

7. A position measuring device for an electromagnetic actuator as claimed in claim 5, wherein the electromagnetic actuator is associated with the valve for an engine.

8. A position measuring device for an electromagnetic actuator as claimed in claim 5, wherein the component is a Hall effect device disposed on a casing of the electromagnetic actuator so as to face the adhesive layer with a space therebetween.

9. A position measuring device for an electromagnetic actuator as claimed in claim 8, wherein the position of the Hall effect device is adjusted to make a center position of the Hall effect device substantially coincident with that of an elongated direction of the permanent magnet whose upper and lower ends has magnetic poles.

10. A position measuring device for an electromagnetic actuator as claimed in claim 5, wherein the hollow cylindrical member is made of a non-magnetic material.

11. A position measuring device for an electromagnetic actuator as claimed in claim 5, wherein the hollow cylindrical member is made of aluminum.

12. A position measuring device for an electromagnetic actuator as claimed in claim 5, wherein a gap section is formed between an end surface of the adhesive layer and an opposing end surface of the small diameter section to serve as a magnetic shield portion.

13. A position measuring device for an electromagnetic actuator as claimed in claim 12, wherein the gap section is filled with a permalloy.

14. An electromagnetic valve actuator comprising:

a movable member associated with a valve;

a magnet utilized in a position measurement of the movable member;

a support member arranged between the movable member and the magnet, the support member elastically mounting the magnet to the movable member, a hardness of the support member being lower than that of the movable member; and a component arranged to detect a magnetic field of the magnet for measuring the position of the movable member, wherein the movable member includes a sleeve attached at an end portion thereof, the support member mounts the magnet to the sleeve, wherein a gap is arranged between the end portion of the movable member and the magnet so as to provide a magnetic shield.

15. An electromagnetic valve actuator as claimed in claim 14, wherein the support member is an adhesive layer surrounding the magnet.

16. An electromagnetic valve actuator as claimed in claim 15, wherein the support member is made of an epoxy resin.

17. An electromagnetic valve actuator as claimed in claim 14, wherein the magnet is of a bar shape.

18. An electromagnetic valve actuator as claimed in claim 14, further comprising a pair of electromagnets, wherein the movable member has an armature, the pair of electromagnets attract the movable member so as to displace the valve.

19. An electromagnetic valve actuator as claimed in claim 14, wherein the component is arranged so as to face the end portion of the movable member with a predetermined space therebetween.

20. An electromagnetic valve actuator as claimed in claim 19, wherein the component is a Hall effect device.

21. An electromagnetic valve actuator as claimed in claim 14, wherein the sleeve has a cylindrical hole, the magnet is arranged in the cylindrical hole.

22. An electromagnetic valve actuator for an engine as claimed in claim 14, wherein the sleeve is made of non-magnetic material.

23. An electromagnetic valve actuator as claimed in claim 14, wherein the sleeve is made of a nonmagnetic material, and the movable member is made of magnetic material.

24. An electromagnetic valve actuator as claimed in claim 14, wherein the sleeve is made of aluminum, and the movable member is made of magnetic material.

25. An electromagnetic valve actuator as claimed in claim 14, wherein the sleeve is made of aluminum.

26. An electromagnetic valve actuator as claimed in claim 14, wherein the component is arranged at a hollow shaped portion of a main body of the electromagnetic valve actuator, the end portion of the movable member having the magnet moves in the hollow shaped portion with a predetermined space.

27. A method for attaching a position measuring device of an electromagnetic actuator, the electromagnetic actuator comprising a movable section and a permanent magnet used to detect a displacement position of the movable section, the method comprising attaching the permanent magnet onto the movable section via a predetermined material that has a lower hardness than that of the movable section, wherein the predetermined material is a substantially cylindrical shaped material, wherein a magnetic shield portion is disposed between the movable section and the permanent magnet.

28. A method for attaching a position measuring device of an electomagnetic actuator as claimed in claim 27, wherein the magnetic shield portion is a gap formed between the movable section and the permanent magnet.

29. A method for attaching a position measuring device of an electromagnetic actuator as claimed in claim 28, wherein the gap is filled with a permalloy.

30. A position measuring device for an electromagnetic actuator having a movable section associated with a valve comprising:

a permanent magnet attached onto the movable section via a predetermined material that has a lower hardness than that of the movable section to detect a displacement position of the movable section; and a component arranged to detect a magnetic field of the permanent magnet for measuring the position of the movable section, wherein the predetermined material is an adhesive layer enclosing the permanent magnet, wherein the movable section comprises a small diameter section and a hollow cylindrical member whose inner periphery is fitted into an outer periphery of the small diameter section, wherein the adhesive layer is interposed between the inner periphery of the hollow cylindrical member and an outer periphery of the permanent magnet.

31. A position measuring device for an electromagnetic actuator as claimed in claim 30, wherein the hollow cylindrical member is made of a non-magnetic material.

32. A position measuring device for an electromagnetic actuator as claimed in claim 30, wherein the hollow cylindrical member is made of aluminum.

33. A position measuring device for an electromagnetic actuator as claimed in claim 30, wherein a gap section is formed between an end surface of the adhesive layer and an opposing end surface of the small diameter section to serve as a magnetic shield portion.

34. A position measuring device for an electromagnetic actuator as claimed in claim 33, wherein the gap section is filled with a permalloy.

* * * * *